United States Patent [19]

Bruneau

[11] Patent Number: 4,728,162

[45] Date of Patent: Mar. 1, 1988

[54] DEVICE FOR THE COMPENSATED GUIDANCE AND GRADUATED OPENING OF THE DOOR OF A VERTICAL FILING CABINET FOR SUSPENDED PLANS

[75] Inventor: Alain Bruneau, Montferrand le Chateau, France

[73] Assignee: Alpia S.A., Besancon, France

[21] Appl. No.: 17,141

[22] Filed: Feb. 20, 1987

[30] Foreign Application Priority Data

Mar. 12, 1986 [FR] France ..... 86 04116

[51] Int. Cl.[4] ..... A47B 88/16

[52] U.S. Cl. ..... 312/333; 312/348

[58] Field of Search ..... 312/333, 348, 189

[56] References Cited

U.S. PATENT DOCUMENTS

| | | | |
|---|---|---|---|
| 3,141,714 | 7/1964 | Valitus | 312/348 |
| 3,462,203 | 8/1969 | Del Vecchio | 312/348 |
| 4,423,914 | 1/1984 | Vander Ley | 312/348 |
| 4,441,772 | 4/1984 | Fielding et al. | 312/333 |
| 4,549,773 | 10/1985 | Papp et al. | 312/348 |
| 4,557,531 | 12/1985 | Rock et al. | 312/333 |
| 4,560,212 | 12/1985 | Papp et al. | 312/348 |

*Primary Examiner*—Victor N. Sakran

*Attorney, Agent, or Firm*—Robert E. Burns; Emmanuel J. Lobato

[57] ABSTRACT

The invention relates to filing cabinets for suspended plans. The means for the compensated guidance and graduated opening of the door (2) comprise at least one guide arm (3) carrying, at its free end, at least one roller (30, 31) sliding in a slide track (4) fastened to the frame (1) of the cabinet. Each arm is supported, at the entrance of the slide track, by at least one roller (15) pivoting on a journal (15') fastened to the frame. The guide arm is equipped with a movable stop (6) having a spring stud (7) and pivoting on a journal (5) and with a fixed stop (9). A plate (10) fastened to the frame retains the guide arm in the slide track; this plate has means for the graduated opening of the door which comprises an ejector (12) pivoting on a journal (11), a stop (13) and a reactivating finger (14).

13 Claims, 13 Drawing Figures

DEVICE FOR THE COMPENSATED GUIDANCE AND GRADUATED OPENING OF THE DOOR OF A VERTICAL FILING CABINET FOR SUSPENDED PLANS

FIELD OF THE INVENTION

The invention relates to vertical-filing cabinets for suspended plans, particularly to a device for the compensated guidance and graduated opening of the door in predetermined positions.

PRIOR ART

In known cabinets, the plans are suspended by means of two parallel sets of pins contained in one and the same plane, one fastened to the upper part of the frame of the cabinet and the other fastened at the same level to the vertical sliding door of the said cabinet.

A plan to be filed is selected by opening the door to a greater or lesser extent, first to select the position of the plan on the pins, then by continuing to open the door until the spacing between the pins makes it possible to remove or suspend the selected plan.

This often results in an accumulation of the weight of the plans on the pins of the door at the moment when the opening of the latter is sufficient to leave a free space between the two sets of pins, making it possible to introduce or remove the selected plan.

When the door is being closed, the set of pins which it supports, together with the weight of the suspended plans, must remain strictly parallel and in the same plane as the set of pins fastened to the frame, the guidance of the door assuming importance because of this.

In general, the guide device for the opening part is composed of two slide tracks, each comprising four rollers or ball bearings, all four arranged either on the movable part, namely the door, or on the fixed part, namely the cabinet frame:

When they are on the fixed part, the movable part carries a guide profile passing on the inside or on the outside of the four rollers;

When they are on the movable part, the fixed part carries a guide profile passing on the inside or on the outside of the four rollers.

In either case, the guide length is constant and at a minimum, whether in the open position or in the closed position.

The plans are manipulated in the known vertical-filing cabinets in two stages:

First opening stage

Identifying the plan to be extracted and sliding the plans upstream on the pins of the movable part,

Second opening stage

Forming a passageway between the fixed pins and the movable pins, making it possible to extract the selected plan.

In the known cabinets, these two opening stages are carried out by acting manually on a control button or actuating pull, in order to move the slide tracks by releasing them. The finger thus released drops into a nolch corresponding to the first stage. Further action is required to release the slide tracks and move them and so reach the second opening stage.

SUMMARY OF THE INVENTION

The object of the present invention is to improve the accuracy of guidance of the movable part at the most important moment of this function, that is to say at the moment when the pins of the upper part of the door, which support the plans, have to penetrate into the perforations in the suspension bands for the plans supported by the pins fastened to the frame of the cabinet.

It also involves doing away with any manual action on the opening mechanism by using means for the automatic detection of at least two predetermined positions of the door in relation to the frame of the cabinet.

For this purpose, each guide arm of the movable part is equipped, at its end opposite the door, with at least one roller bearing on the runways of the corresponding slide track fastened to the frame, and each slide track has, on its end nearest the door, at least one track roller controlling the guide arm in its slide track.

The guidance of the door is completed by detection means comprising a first movable stop on the guide arm and a second stop fixed to the frame of the cabinet.

The first movable stop interacts with an ejector controlled by the movement of the door so as to assume two end positions corresponding to two programmed degrees of opening of the door.

For a cabinet loaded to 75% of its capacity, the quality of guidance must be at its highest approximately in mid-travel. Consequently, the guide device described below has one or two rollers fastened to the end of the guide arms of the door and one or two rollers fastened on each side of the frame of the cabinet.

In the maximum opening position, with the stop up against the fixed rollers of the frame, there is minimum guidance, but when the cabinet is closed the guidance improves and the guide length is more than doubled in mid-travel.

BRIEF DESCRIPTION OF THE DRAWINGS

Other advantages will emerge from the description of a preferred embodiment, given by way of non-limiting example, and from the drawing in which.

DESCRIPTION OF THE PREFERRED EMBODIMENT

Figure 1:
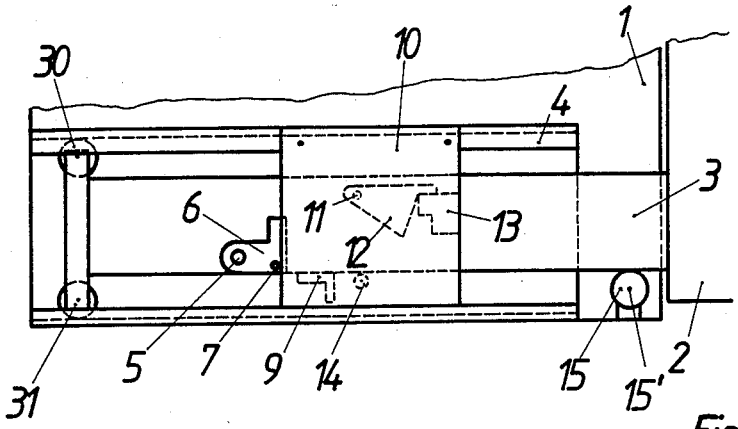
FIG. 1 is a diagram of the device, the door being closed.

The vertical-filing cabinet is composed of a frame 1 which corresponds to the size of the plans and which is closed by a door 2, supported by two guide arms 3 which each move within a C-shaped profile, integral with the frame and serving as a slide track 4 open towards the inside of the frame, along two parallel and superposed runways 40, 41.

Figure 2:
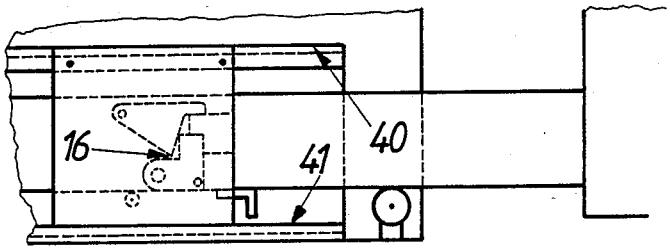
FIG. 2 is a diagram of the device in the position for selecting the plans.

At least one guide arm carries, on its lower face, a limit stop 9 and, on its side face directed towards the inside of the frame, a journal 5, on which is articulated a movable stop 6 having a recess 16 (FIG. 2).

A spring stud 7 penetrating into a hole 8 in the guide arm is fastened to the movable stop 6.

A plate 10, fitted after the arm 3 has been inserted into the slide track 4, is fastened to the frame 1; it partially encloses, in the slide track 4, the guide arm equipped with the above-mentioned stops 6 and 9. This plate 10, on its face turned towards the inside of the slide track 4, carries a stop 13, a reactivating finger 14 and a journal 11, on which an ejector 12 is articulated.

Figure 4:
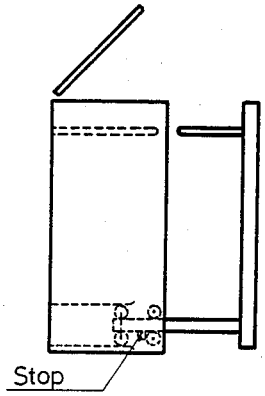
FIGS. 4 and 5 show a diagram of the means of guiding the door, comprising two rollers fastened to the free end of the guide arm and two rollers fastened to the frame of the cabinet at the entrance of slide track.
Figure 5:
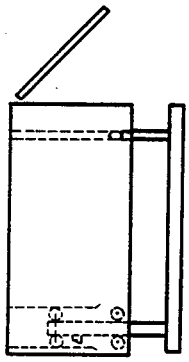
Figure 4A:
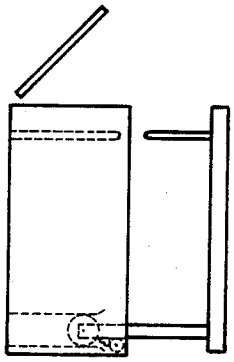
FIGS. 4*b* and 5*b* show a diagram of the means of guiding the door, comprising a single roller fastened to the free end of the guide arm and having a diameter corresponding to the spacing between the runways of the slide track, and a single roller fastened to the frame of the cabinet of the entrance of the slide track.
Figure 5A:
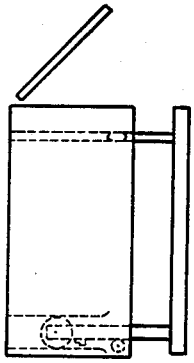

Each of the guide arms 3 carries, at its free end, either a single roller (FIGS. 4*b* and 5*b*), the diameter of which is equal to the distance between the runways 40, 41 of the slide track 4, or a pair of rollers 30, 31, of which the position tangential to these runways 40, 41 ensures strict guidance of the guide arm 3 carrying them.

A first roller 15, located in the region of the lower runway 41 of the slide track 4 near the opening in the cabinet and pivoting on a journal 15' fastened to the frame 1, contributes to controlling the guide arm 3 in the slide track 4.

Figure 3:
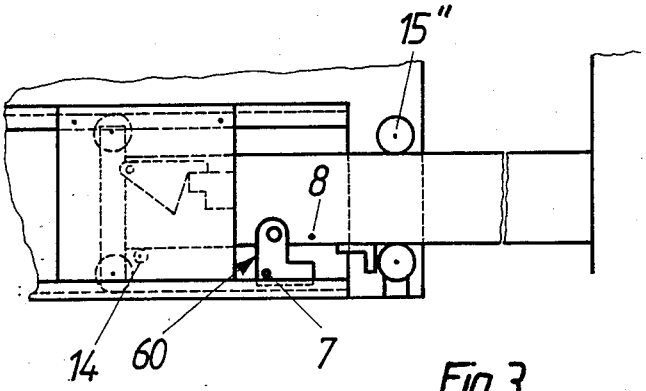
FIG. 3 is a diagram of the device, the door being open.

A second roller 15" (FIG. 3) can be arranged above the guide arm to reinforce the directional action of the roller 15.

Figure 1A:
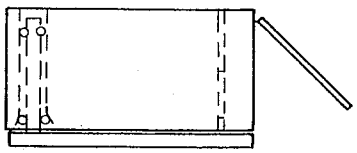
FIG. 1*a* is a sectional view, with the door closed.
Figure 1B:
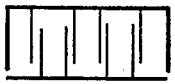
FIG. 1*b* is a plan view, with the door closed.
Figure 2A:
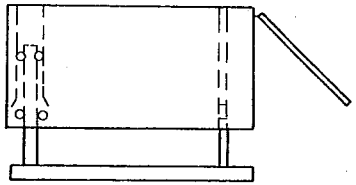
FIG. 2*a* is a sectional view in the selection position.
Figure 2B:
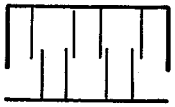
FIG. 2*b* is a plan view in the selection position.
Figure 3A:
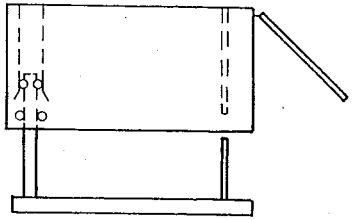
FIG. 3*a* is a sectional view, with the door open.
Figure 3B:
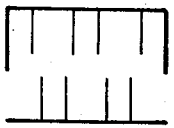
FIG. 3*b* is a plan view, with the door open.

The mode of operation of this device is described as follows:

When the door 2 is closed (FIGS. 1, 1*a* and 1*b*), the movable stop 6 is aligned with the guide arm 3, and the spring stud 7 is engaged in the hole 8 in the arm 3 and keeps the movable stop in alignment;

During a first opening stage (FIGS. 2, 2*a* and 2*b*), the movable stop 6 comes up against the stop 13 fastened to the plate 10 and thus temporarily limits the opening of the door 2; the ejector 12 pivoting on its journal 11 engages behind a recess 16 of the movable stop 6;

When the door is pushed back 2 to 3 centimeters, the movable stop 6 drives the ejector 12 in rotation about its journal 11. During its rotation, the ejector exerts a transverse force on the movable stop 6 and expels the spring stud 7 from the hole 8. The movable stop 6 released in this way assumes a vertical orientation as a result of gravity by pivoting on the journal 5 and adopts a position perpendicular to the guide arm 3;

During a second opening stage (FIG. 3, 3*a* and 3*b*), the movable stop 6, released and put in a position perpendicular to the guide arm, passes under the stop 13; the maximum opening of the door 2 is obtained when the stop 9 comes up against the roller 15 controlling the guide arm 3.

Reactivation and closure

When the door 2 is closed, the guide arm 3 drives the movable stop 6 with it. The part 60 of this stop, which is located under the guide arm 3 after the door has been opened (FIG. 3), strikes against the reactivating finger 14 during the movement of closing the door. The movable stop 6 is forced to resume alignment with the guide arm 3, the spring stud 7 automatically resuming its position in the hole 8 of the guide arm.

A magnetic catch keeps the door in its closed position, so that in the event of frequent use there is no need to use the key-operated lock.

I claim:

1. A device for the compensated guidance and graduated opening of the pending part of a cabinet composed of a fixed part, namely a frame, and of a movable part, namely a door, which, supported by at least one guide arm, moves away from the cabinet in a plane parallel to its largest wall, the guide arms each sliding in a slide track fastened to the frame, and means being provided for graduating the opening of the door, wherein each guide arm (3) is equipped, at its end opposite the door, with at least one roller bearing on the runways of the corresponding slide track (4) fastened to the frame (1), wherein each slide track has, on its end nearest the door, at least one track roller fastened to the frame and controlling the guide arm in its slide track, wherein blocking means for said door comprise a magnetic catch keeping the door in a closed position, a first stop (6) movable on the guide arm and a second stop (13) fastened to a plate (10) partially closing off the respective slide track, and wherein the first movable stop interacts with an ejector (12) controlled by the movement of the door so as to assume two positions corresponding to two programmed degrees of opening of the door, said door (2) of the cabinet being supported by two guide arms (3), wherein at least one of these guide arms has on its free end two guide rollers (30, 31), on its lower face a limit stop (9) and, on its lateral face directed towards the inside of the filing cabinet, a journal (5), on which is articulated a movable stop (6) having a recess (16), and wherein a spring stud (7) penetrating into a hole (8) in the guide arm is fastened to the movable stop.

2. A device as claimed in claim 1, wherein a C-shaped profile having two runways (40, 41) is fastened on each side of the frame (1), to serve as a slide track (4) for each guide arm (3).

3. A device as claimed in claim 2, wherein at least one roller (15, 15") for controlling the guide arm (3) in the slide track (4) is fastened to the frame (1) near the opening of the door (2) tangentially to the runway (40, 41) of the slide track (4).

4. A device as claimed in claim 1, wherein a plate (10) fastened to the frame (1) partially closes off the slide tack (4), and wherein this plate is fitted after the guide arm (3) has been inserted into the slide track.

5. A device as claimed in claim 4, wherein a journal (11), on which an ejector (12) is articulated, a stop (13) and a reactivating finger (14) are fastened to the face of the plate (10) directed towards runways (40, 41) of the slide track (4).

6. A cabinet having opposite sides and a front opening and a door for closing said opening, means for guiding and controlling movement of said door, said means comprising horizontal guide arms on said door received in said guideways and movable longitudinally in said guideways for movement of said door between closed and open positions stationary stops associated with said guideways, movable stops pivotally mounted on said guidearms for movement between a first portion for engagement with said stationary stops and a second position in which they are not engageable with said stationary stops, means for releasably retaining said movable stops in said first position, said stationary stops and said movable stops being positioned to stop the opening of said door in an intermediate position by engagement of said movable stops with said stationary stops.

ejector means operable by movement of said door from said intermediate position slightly toward closed position for effecting movement of said moveable stops from said first portion to said second position to permit movement of said door toward open position, and means for halting movement of said door when it reaches open position.

7. Guidance and control means according to claim 6, in which said ejector means comprises a cam member pivotally mounted on a plate affixed to said track and engageable with said movable stop to effect movement of movable stop from said first position to said second position.

8. Guidance and control means according to claim 6, in which each of said guideways is C-shaped with an upper runway and a lower runway and in which each of said guide arms has on its free end two guide rollers engageable respectively with said upper and lower runways and on its lower face a limit stop engageable with a fixed abutment to limit opening movement of said door.

9. Guidance and control means according to claim 6, in which each of said guideways is C-shaped with an upper runway and a lower runway an in which each of said guide arms has on its free end a roller having a diameter corresponding to the distance between said upper and lower runways and on its lower face a limit stop engageable with a fixed abutment to limit opening movement of said door.

10. Guidance and control means accordance with claim 6, in which said movable stop is L-shaped and in which said means for releasably retaining said movable stop in said first position comprise a spring stud on said movable stop engageable with a hole in said guide arm.

11. Guidance and control means according to claim 6, in which rollers mounted in said cabinet near said front opening are engageable with said guide arms to guide said guide arm in their movement

12. Guidance and control means according to claim 6, in which said movable stop is gravity biased to move from said first position to said second position and in which said ejector means comprises means for releasing said movable stop from said first position whereupon said movable stop falls by gravity to said second position.

13. Guidance and control means according to claim 12, further comprising a reactivating finger engageable with each of said movable stops to move said movable stops from said second position to said first position when said door is moved toward closed position.

* * * * *